US007913839B2

(12) United States Patent
Fawcett et al.

(10) Patent No.: US 7,913,839 B2
(45) Date of Patent: Mar. 29, 2011

(54) MERCHANDISE SECURITY DISPLAY BAG

(75) Inventors: Christopher J. Fawcett, Charlotte, NC (US); Ronald M. Marsilio, Lake Wiley, SC (US)

(73) Assignee: Checkpoint Systems, Inc., Philadelphia, PA (US)

( * ) Notice: Subject to any disclaimer, the term of this patent is extended or adjusted under 35 U.S.C. 154(b) by 1245 days.

(21) Appl. No.: 11/484,053

(22) Filed: Jul. 11, 2006

(65) Prior Publication Data

US 2008/0024300 A1 Jan. 31, 2008

(51) Int. Cl.
*B65D 30/06* (2006.01)

(52) U.S. Cl. ..... 206/315.3; 206/315.1; 206/315.2

(58) Field of Classification Search .... 206/315.1–315.3; 24/303, 688, 94; 211/54.1
See application file for complete search history.

(56) References Cited

U.S. PATENT DOCUMENTS

| | | | | | |
|---|---|---|---|---|---|
| 1,201,972 | A | | 10/1916 | Kelly | |
| 1,982,813 | A | | 12/1934 | Jacobi | |
| 2,019,044 | A | * | 10/1935 | Brown | 220/9.1 |
| 3,831,407 | A | | 8/1974 | Coleman | |
| 4,941,235 | A | * | 7/1990 | Aoki | 24/303 |
| 4,979,833 | A | * | 12/1990 | Cook | 383/12 |
| 5,790,029 | A | * | 8/1998 | Curnutte et al. | 340/572.1 |
| 5,934,530 | A | * | 8/1999 | Antczak et al. | 224/197 |
| 6,026,662 | A | * | 2/2000 | Schlipper | 70/18 |
| 6,237,654 | B1 | * | 5/2001 | Sheyer | 141/330 |
| 6,244,081 | B1 | * | 6/2001 | Schlipper | 70/18 |
| 6,371,645 | B1 | * | 4/2002 | Rusert et al. | 383/107 |
| 7,069,753 | B2 | * | 7/2006 | Schlipper | 70/18 |
| 7,392,673 | B2 | * | 7/2008 | Fawcett et al. | 70/14 |
| 2003/0110818 | A1 | | 6/2003 | Schlipper | |
| 2003/0224716 | A1 | * | 12/2003 | Manfre-Mooney et al. | 453/63 |
| 2005/0223624 | A1 | * | 10/2005 | Gaughen et al. | 43/100 |
| 2006/0021394 | A1 | * | 2/2006 | Belden | 70/57.1 |
| 2006/0157431 | A1 | * | 7/2006 | Nagelski et al. | 211/54.1 |

* cited by examiner

*Primary Examiner* — Anthony Stashick
*Assistant Examiner* — Cynthia F Collado
(74) *Attorney, Agent, or Firm* — Sand & Sebolt

(57) ABSTRACT

A security bag for displaying items of merchandise includes a mesh bag formed of metal wire providing an internal storage chamber. A two-piece member locking device is attached to an open end of the bag. A magnetically attachable locking tine is mounted in one of the members and engages a locking projection on the second member which is slidably received into the first member to lock the bag in a closed position protecting the stored merchandise from theft. An EAS tag is secured within one of the locking members. A magnetic key moves the locking tine to an unlocked position when placed adjacent the locking tine enabling the two locking members to be separated into an unlocked position and the bag open end spread apart for removing items therefrom.

20 Claims, 11 Drawing Sheets

MERCHANDISE SECURITY DISPLAY BAG

BACKGROUND OF THE INVENTION

1. Technical Field

The invention relates to security devices for displaying items of merchandise and in particular to a mesh bag adapted to contain various shaped items having a two-piece locking member mounted on the periphery of the bag opening to secure the bag in a closed locked position.

2. Background Information

Numerous items of merchandise are displayed for sale on various display mechanisms such as long protruding rods which extend from a support structure for holding and displaying the items of merchandise. Usually the items are stored in box-like protective housings or bubble packs which easily conform to the shape of the item of merchandise. However, these bubble packs and boxes are easy targets for thieves who cut the package or pack with a razor blade and remove the contents therefrom. It becomes expensive to protect each of these packages from theft without decreasing the visibility and accessibility to the customers. Also, it is desirable to have a number of such items on the display rack with some of the items securely protected until several of the unprotected items are removed by a customer for purchase and then replaced with the protected items.

Also, various items of merchandise which have irregular, large and bulky shapes are difficult to be placed in a secured box or package without obstructing the view of the merchandise by a prospective buyer and without resulting in wasted storage space. It is has been found that for certain items of merchandise that placement of these items, such as boxing gloves, ball gloves or various irregular shaped objects can be displayed by placing the items in a mesh bag which enables the user to view the item of merchandise.

Therefore, the need exists for a secure display device for various items of merchandise including irregular shaped objects which can be displayed in a simple, effective, inexpensive yet secure manner in a locked container requiring a key to unlock the security display package.

BRIEF SUMMARY OF THE INVENTION

The present invention provides a security device for various items of merchandise that protects the merchandise in a mesh bag, preferably formed out of metal wires which prevent thieves from unlawfully removing the merchandise from the package without removing the package from the display structure and/or retail store.

Another feature of the present invention is to provide a security bag which has an open top through which items of merchandise are placed into and removed from an interior storage chamber formed in the bag, which open top is closed with a two-piece locking member formed of inexpensive, rugged plastic material.

A further object of the present invention is to provide one of the two bag locking members with a magnetically attractable locking strip or tine which automatically moves into a locked engagement with the second member of the locking device when the members are slidably inserted into engagement with each other when closing the bag.

Another aspect of the present invention is to provide such a security bag which is unlocked by a magnetic key, which when properly placed on the locking device will move one or more metal locking tines to an unlocked position enabling one of the locking members to be slid out of engagement with the other locking member enabling the bag opening to be expanded to a full open position for removing the protected items of merchandise from within the storage chamber.

A further feature of the present invention is to provide one of the locking members with an abutment locking surface which engages an elongated edge of a magnetically attractable locking tine to prevent movement of the locking members from the locked to the unlocked position instead of the heretofore locking devices wherein only a small extended end of a magnetically attractable tine engages an abutment member to maintain the locking device in an unlocked position. This provides increased resistance to a forceful unauthorized separation of the pair of locking members.

Still another feature of the present invention is to secure the two members of the locking device on opposite, approximately half portions of the bag opening periphery, by trapping closed loop ends of the mesh bag in slots formed in each of the locking members thereby preventing the locking members from being misplaced from the mesh bag and preventing a thief from removing the locking members from the mesh bag.

A further aspect of the present invention is to secure the magnetically attractable locking strip in a completely protected manner within one of the locking members preventing access thereto by a potential thief.

Another feature of the present invention is to enable an EAS tag to be secured within one of the locking members preventing a thief from removing the security bag from a retail store without sounding the alarm at an alarm exit gate.

A still further aspect of the present invention is to form the two lock members of a rigid plastic material which is sufficiently strong to prevent a thief from easily prying the two members apart, and which is constructed of a minimum number of components thereby enabling the security bag to be mass produced relatively inexpensively encouraging the use thereof by merchants to reduce shoplifting.

These features and advantages are obtained by the security bag of the present invention, wherein the security bag comprises a mesh bag formed of metal wire having a top opening providing access to an interior storage chamber for receiving an item of merchandise; and a locking device for securing the top opening in a closed locked position, wherein the locking device includes first and second locking members, each connected to a portion of the top opening of the bag and lockingly engageable with each other, and wherein the first locking member has a magnetically attractable locking member engageable with a locking tab formed on the second locking member to lock the members in a closed locked position.

BRIEF DESCRIPTION OF THE SEVERAL VIEWS OF THE DRAWINGS

A preferred embodiment of the invention, illustrative of the best modes in which applicant contemplates applying the principles, is set forth in the following description and is shown in the drawings and is particularly and distinctly pointed out and set forth in the appended claims.

Similar numerals refer to similar parts throughout the drawings.

DETAILED DESCRIPTION OF THE INVENTION

Figure 1:
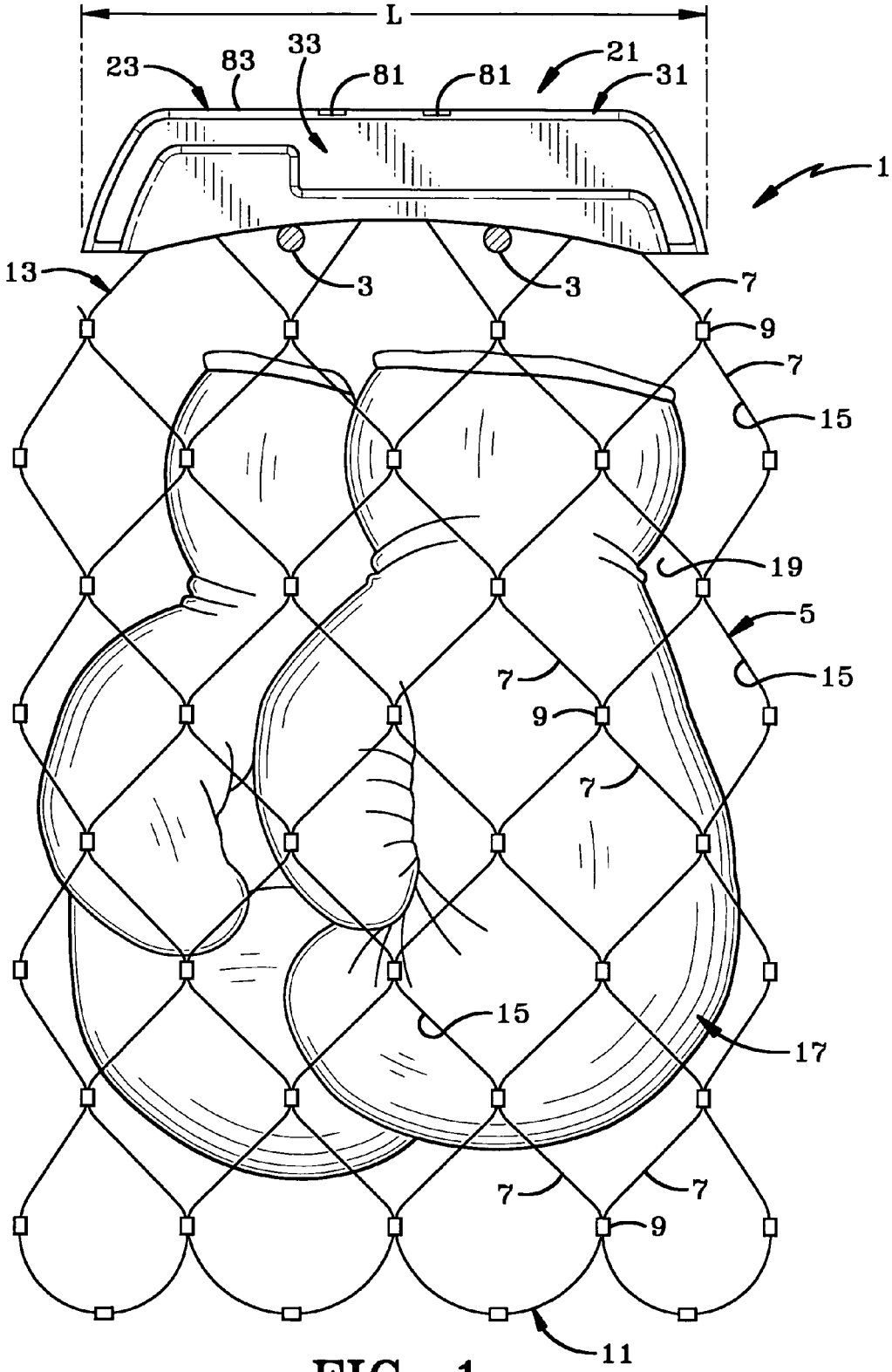
FIG. 1 is a front elevational view of the security bag of the present invention containing an item of merchandise and suspended from a pair of merchandise display rods shown in cross section.
Figure 2:
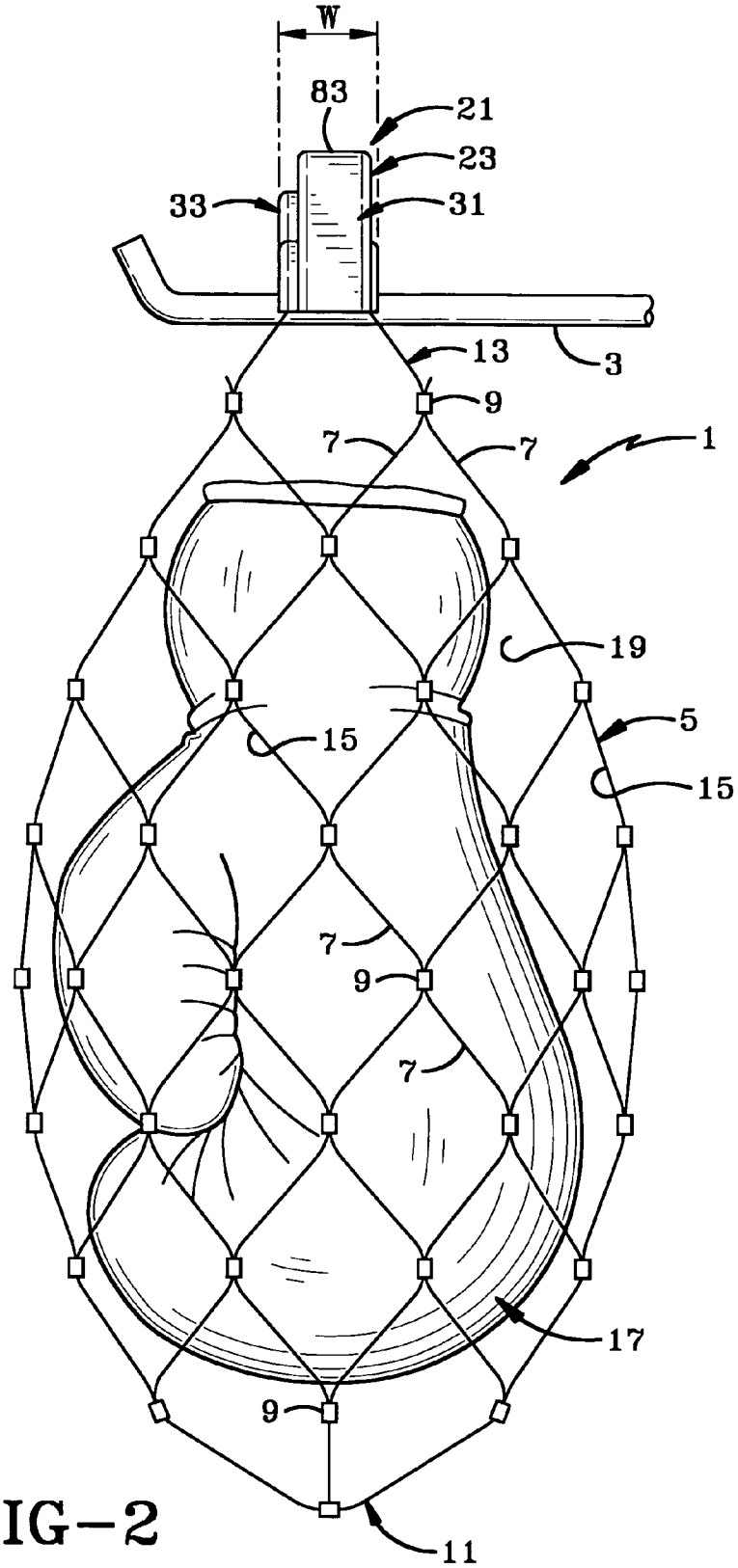
FIG. 2 is a side elevational view of the security bag shown in FIG. 1.

The merchandise security display bag of the present invention is indicated generally at 1, and is shown in FIGS. 1 and 2 mounted on a usual type of display rod 3. However, it is readily understood that bag 1 could be displayed in various manners other than rod 3 and can contain various items of merchandise. Bag 1 includes as its main component a mesh bag indicated generally at 5, preferably formed of metal wire strands 7 which may be connected together by clips, ferrules or other types of fasteners 9 to form a bag-like structure having a closed bottom end 11 and an open top end 13. Metal wires 7 preferably are coated with a plastic material and can be of various thicknesses and types of metal or other materials which are cut resistant without affecting the concept of the present invention. Furthermore, the size of the void areas 15 between the adjacent metal wires 7 can vary depending on the type and size of merchandise 17 to be stored therein. A pair of boxing gloves is shown in FIGS. 1 and 2 and is merely an example of the numerous types of merchandise that can be stored within internal storage chamber 19 provided by mesh bag 5. It is also understood that mesh bag 1 could be formed of other materials than metal wire so long as it prevents or greatly retards cutting of the material.

In further accordance with another feature of the invention, a locking device indicated generally at 21, closes open top end 13 of the bag to secure merchandise 17 in chamber 19. Locking device 21 includes first and second locking members 23 and 25, respectively. Each of the locking members has a generally elongated configuration as shown in FIG. 1 and is adapted to be permanently connected to closed loop ends 27 and 29, respectively, at the peripheral edge of top opening 13, as shown particularly in FIGS. 5 and 6 and discussed in further detail below. Thus locking members 23 and 25 are permanently attached to the peripheral edge of bag opening 13 by the closed loop ends of the bag and remain permanently on the bag with each of the locking members extending across approximately one side of the peripheral edge of the open bag end. Members 23 and 25 preferably have a length "L" approximately four times the width "W". This provides for a compact structure while providing the bag opening 13 to be as large as possible.

Figure 7:
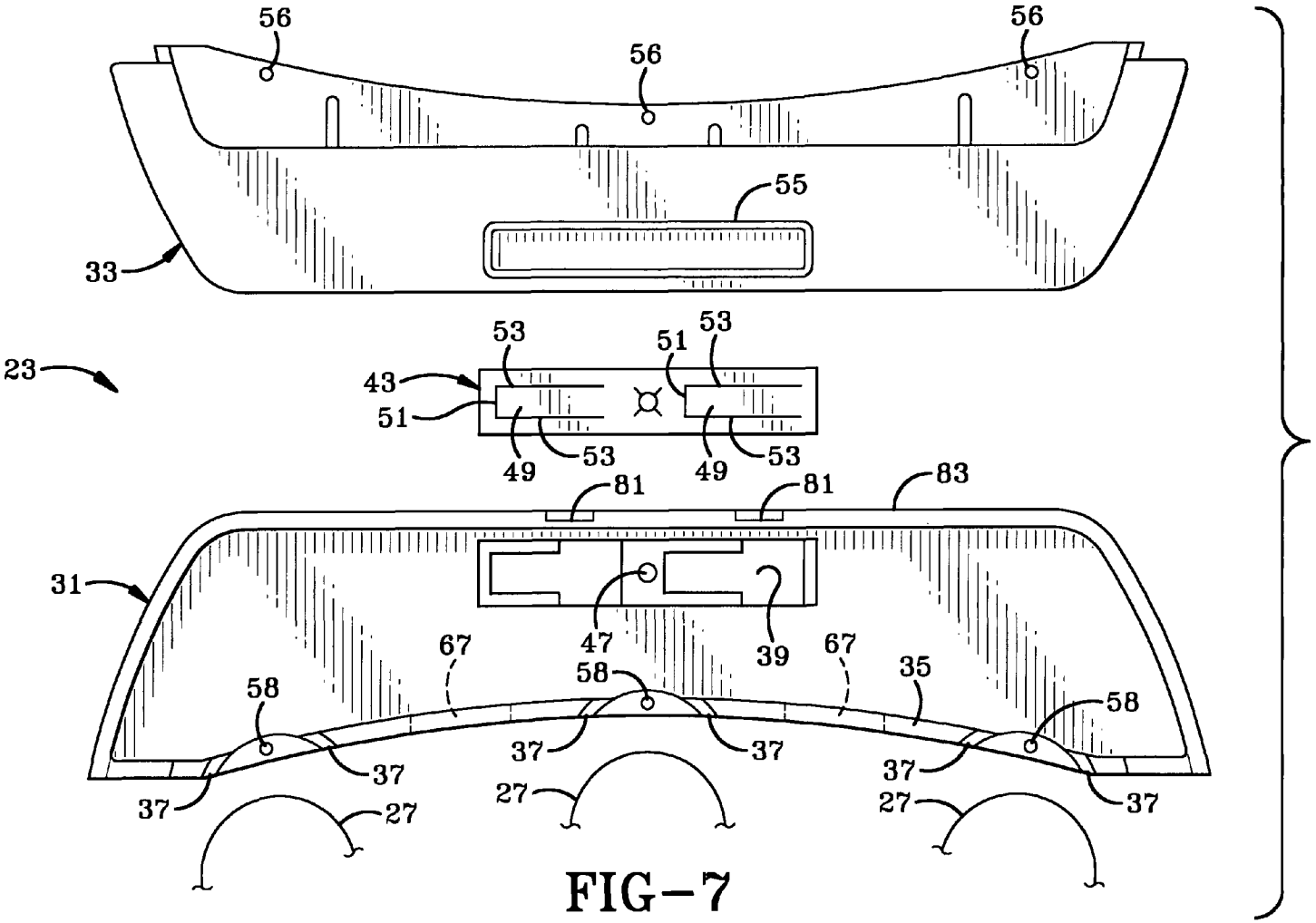
FIG. 7 is an exploded elevational view of the other of the locking members which contains the magnetically attractable locking strip.
Figure 7A:
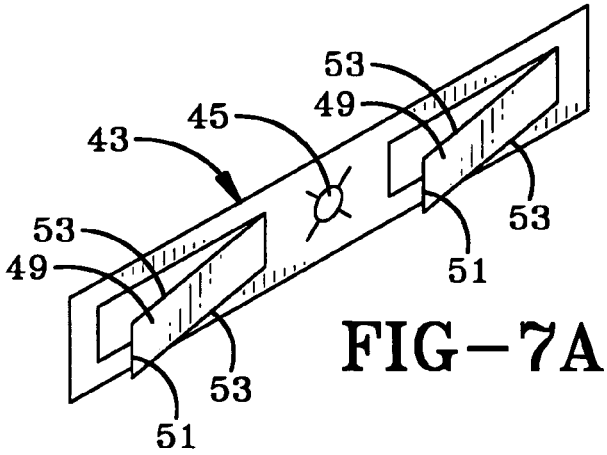
FIG. 7A is an enlarged perspective view of the magnetic locking strip.
Figure 15:
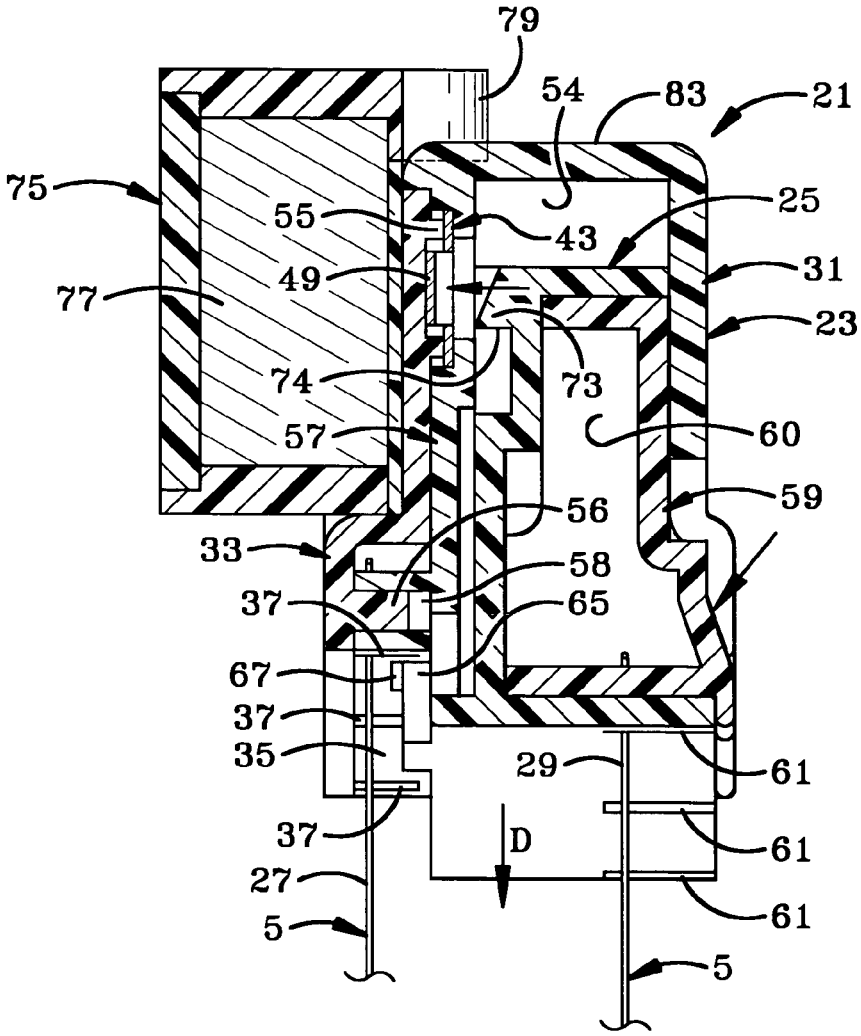
FIG. 15 is an enlarged fragmentary sectional view showing the locking key placed on the locking device with the locking tine being moved toward the unlocked position.

First locking member 23 is shown in an exploded condition in FIG. 7 and includes two main components, a housing 31 and housing cover plate 33. Housing 31 has a generally elongated rectangular configuration with a lower edge 35 formed with a plurality of arcuate slots 37 for receiving the closed loop ends 27 of mesh bag 5. A generally rectangular-shaped recess 39 is formed in an upper portion of housing 31 adjacent top edge 83 for receiving a spring locking strip indicated generally at 43. Spring strip 43 includes a central hole 45 for receiving a positioning pin 47 therethrough for positioning the spring strip within recess 39. Spring strip 43 includes a pair of locking tines 49 which are biased to extend outwardly from the strip as shown in FIG. 7A. Each of the locking tines has an elongated configuration with a distal end 51 and opposed elongated edges 53. Elongated edges 53 preferably are two to three times greater than the width of distal end 51 to provide increased locking strength as discussed below.

Figure 9A:
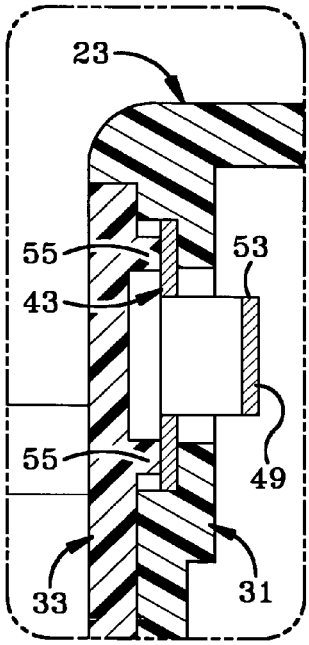
FIG. 9A is an enlarged view of the encircled portion of FIG. 9.

Housing cover plate 33 includes a rectangular-shaped rib 55 which abuts against spring strip 43 as shown in FIG. 9A, to maintain the spring strip within recess 39 of housing 31. A plurality of positioning pins 56 preferably are formed on housing cover plate 33 and extend into positioning holes 58 formed in peripheral edge 35 of housing 31 to properly align and position cover plate 33 on housing 31 prior to permanently connecting the two members together by ultrasonic welding, an adhesive or other types of securing means. Joined members 31 and 33 trap locking strip 43 permanently within recess 39 which communicates with an interior locking chamber 54 formed in locking member 23.

Figure 10:
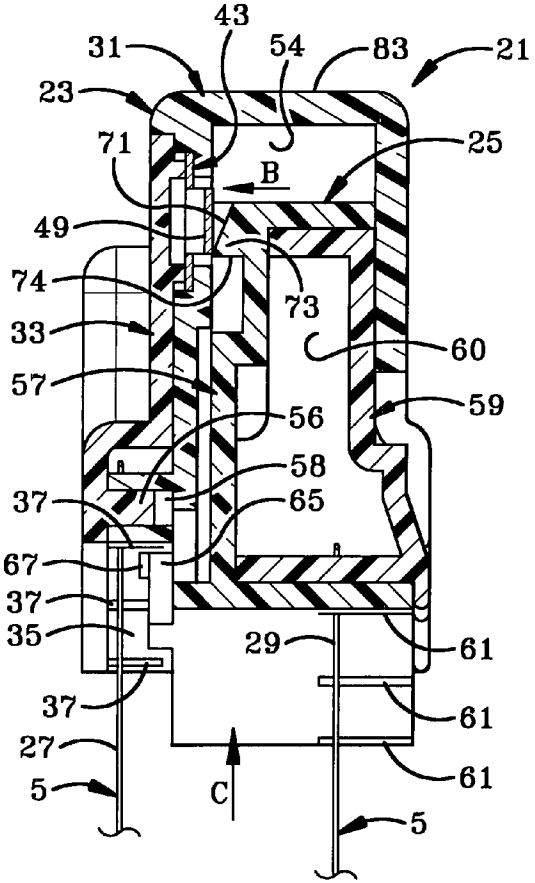
FIG. 10 is a sectional view of the two locking members of FIG. 9 being moved toward the locked position.
Figure 3:
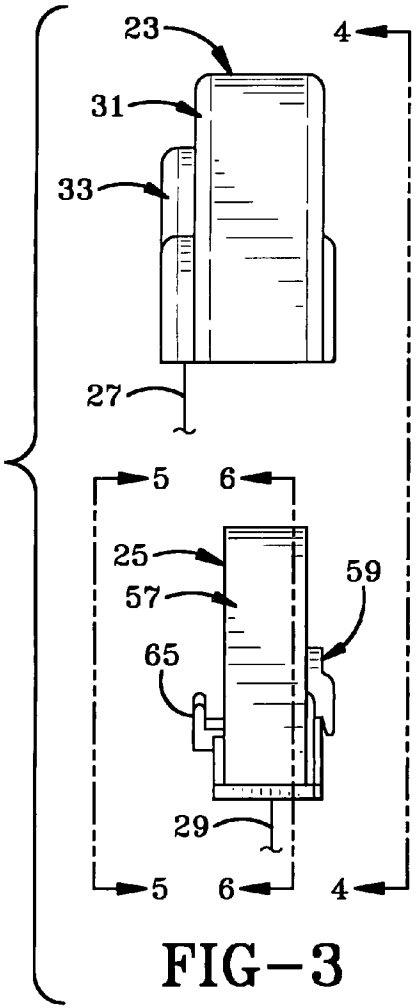
FIG. 3 is a side elevation of the first and second members of the locking device in an open unlocked position with the bag omitted therefrom.
Figure 4:
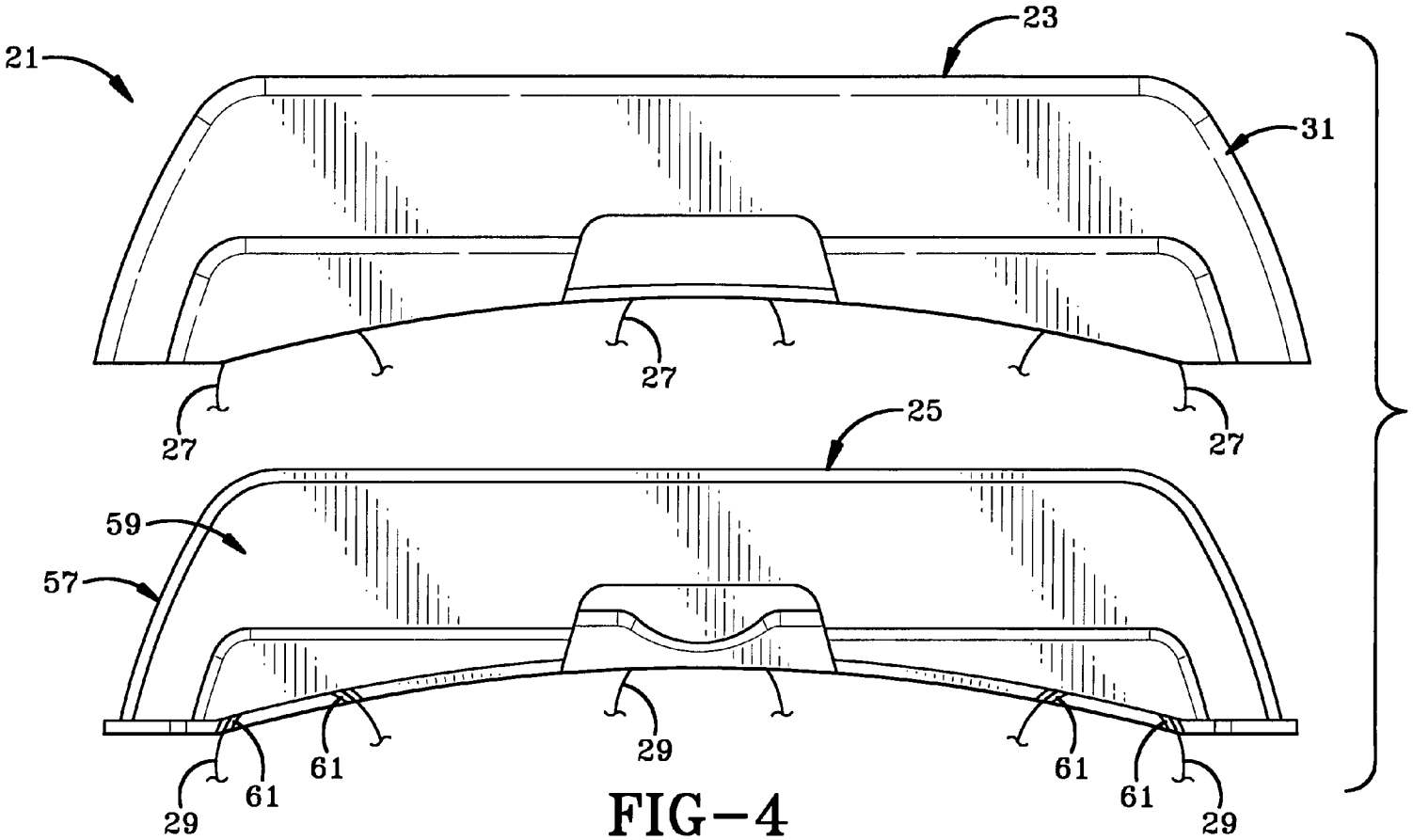
FIG. 4 is an elevational view of the two locking members looking in the direction of arrows 4-4, FIG. 3.
Figure 5:
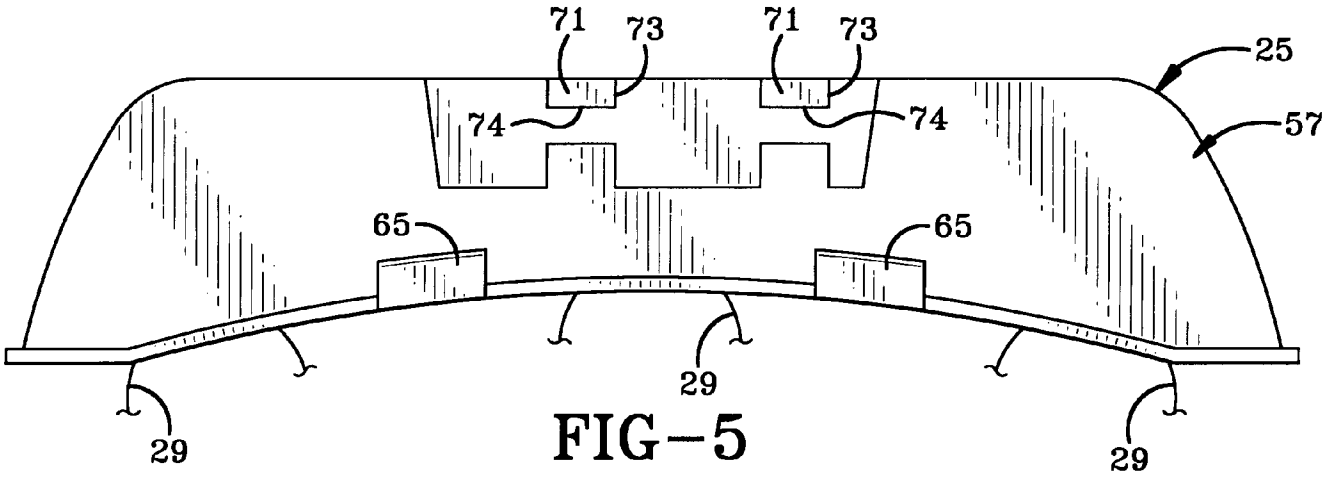
FIG. 5 is an elevational view of one of the locking member looking in the direction of arrows 5-5, FIG. 3.
Figure 6:
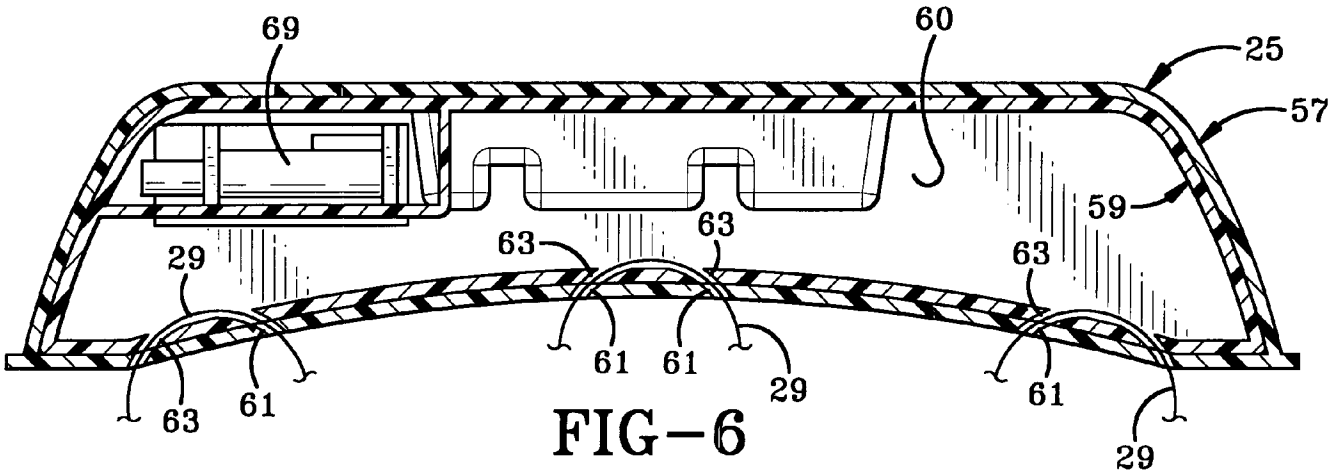
FIG. 6 is a cross sectional view taken on line 6-6, FIG. 3.
Figure 8:
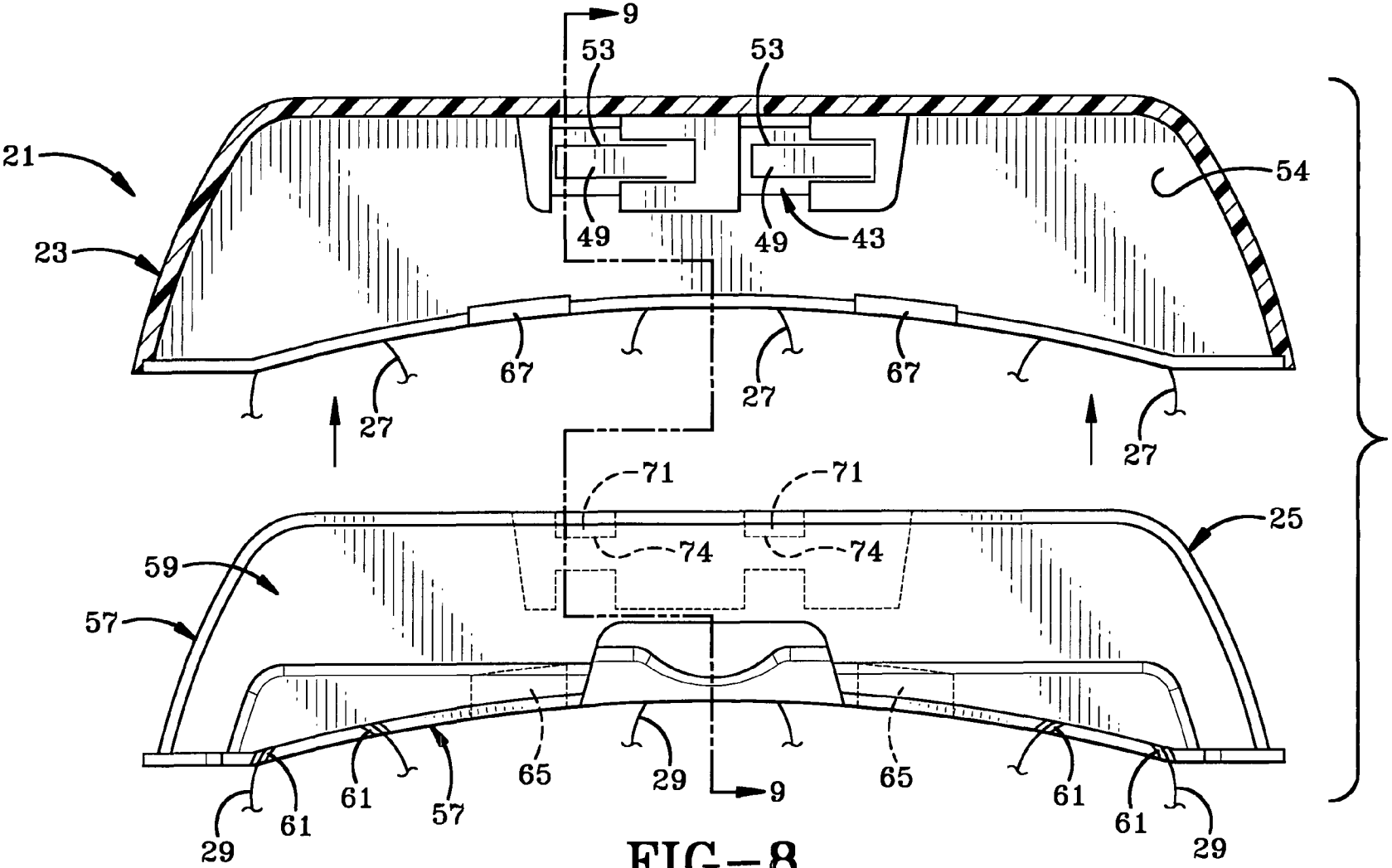
FIG. 8 is an exploded perspective view of the two locking members in an unlocked position with a portion of the upper locking member shown in section.

Second locking member 25 is shown in detail in FIGS. 5, 6 and 8 and includes a main housing 57 and a cover plate 59 which is permanently secured to housing 57 by ultrasonic welding, an adhesive or other securement means as shown in FIG. 6 forming a hollow interior 60. Aligned arcuate slots 61 and 63 are formed in housing 57 and cover plate 59, respectively, for trapping the closed loop ends 29 of mesh bag 5, as shown particularly in FIG. 6. A pair of alignment tabs 65 are formed on housing 57 and are slidably received in slots 67 formed in housing 31 to assist in locking member 25 to member 23 as shown in FIGS. 10 and 11.

Preferably, an EAS tag 69 or other type of alarm activation device is permanently secured within chamber 60 as shown in FIG. 6 for activating an exit alarm gate at a retail establishment should a thief attempt to take the entire security bag 1 in an unauthorized manner through the exit gate. As discussed above, a plurality of closed loop ends 29 extending approximately across one-half the periphery of open bag end 13 are secured within arcuate slots 61 and 63 for permanently attaching second locking member 25 to mesh bag 5.

Figure 11:
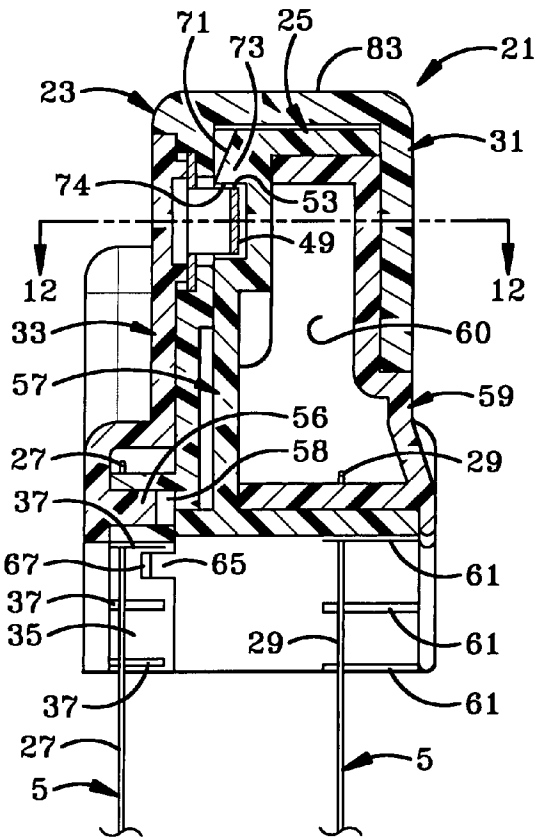
FIG. 11 is a view similar to FIG. 10 with the two locking members in locked position.

The manner of use of locking device 21 is best shown in FIGS. 9-15. After an item of merchandise 17 has been placed in storage chamber 19 through top end opening 13, locking member 25 is moved in the direction of arrow A, FIG. 9, into the interior chamber 54 of locking member 23. Ramped surfaces 71 (FIG. 10) formed on a locking projection 73 provided on the top edge of housing 57 engage extended locking tines 49 and depresses them inwardly as shown by arrow B, FIG. 10, until locking member 25 is completely inserted into chamber 54 of locking member 23 as shown in FIG. 11. In this position locking tines 49 will move outwardly into the locking position as shown in FIG. 11 where they engage an undercut surface 74 of locking projection 73 to prevent locking member 25 from moving in an unlocking direction, opposite to the locking direction as shown by arrow C in FIG. 10. Since tines 49 are spring biased in an outward direction, they automatically lock members 23 and 25 together when member 25 is slidably inserted into lock chamber 54 of member 23 eliminating additional time and effort to secure the merchandise in a secure locked condition.

In accordance with another of the features of the invention, elongated edges 53 of locking tines 49 engage locking projection surfaces 74 to prevent movement of locking member 25 out of locking engagement with locking member 23 providing a relatively large area to resist any forceful separation of housing members 23 and 25. Heretofore, when similar locking tines have been used in a locking device, only the distal ends 51 are engaged by locking projections. This could result in the tines being buckled and snapped out of place if a sufficiently large force is exerted on the locking members. Again, edges 53 are at least twice, and preferably three times the width of distal end 51.

Figure 9:
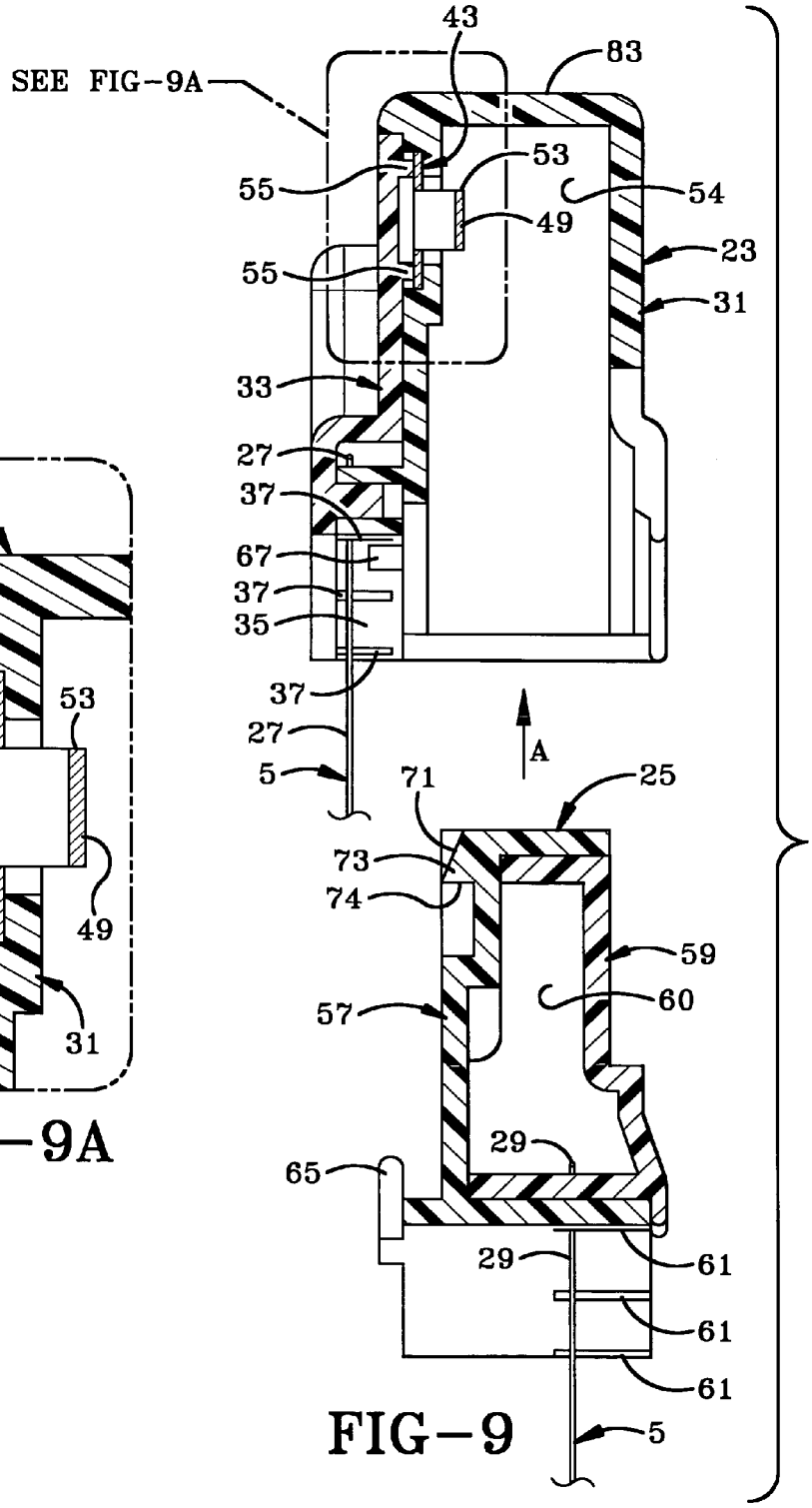
FIG. 9 is a sectional view taken on line 9-9, FIG. 8.
Figure 12:
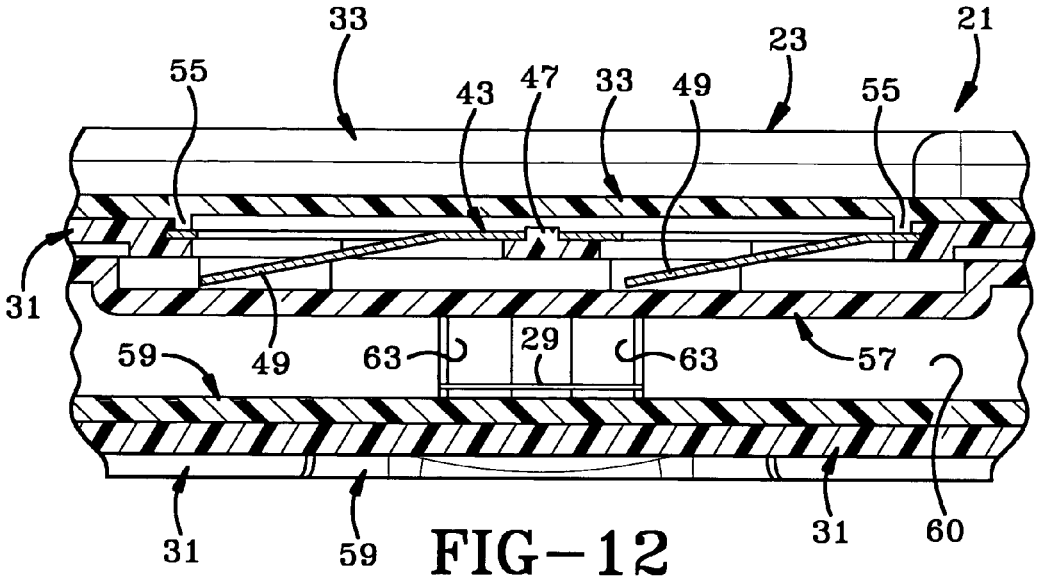
FIG. 12 is a fragmentary sectional view taken on line 12-12, FIG. 11.
Figure 14:
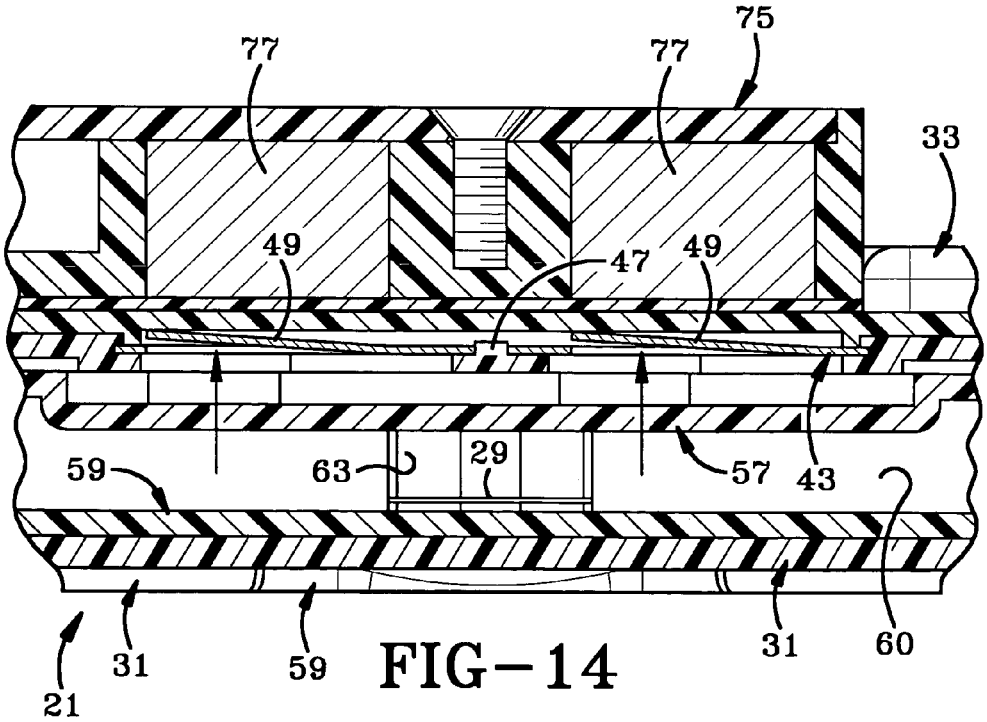
FIG. 14 is an enlarged fragmentary sectional view showing the magnetic key moving the pair of locking tines toward an unlocked position.
Figure 13:
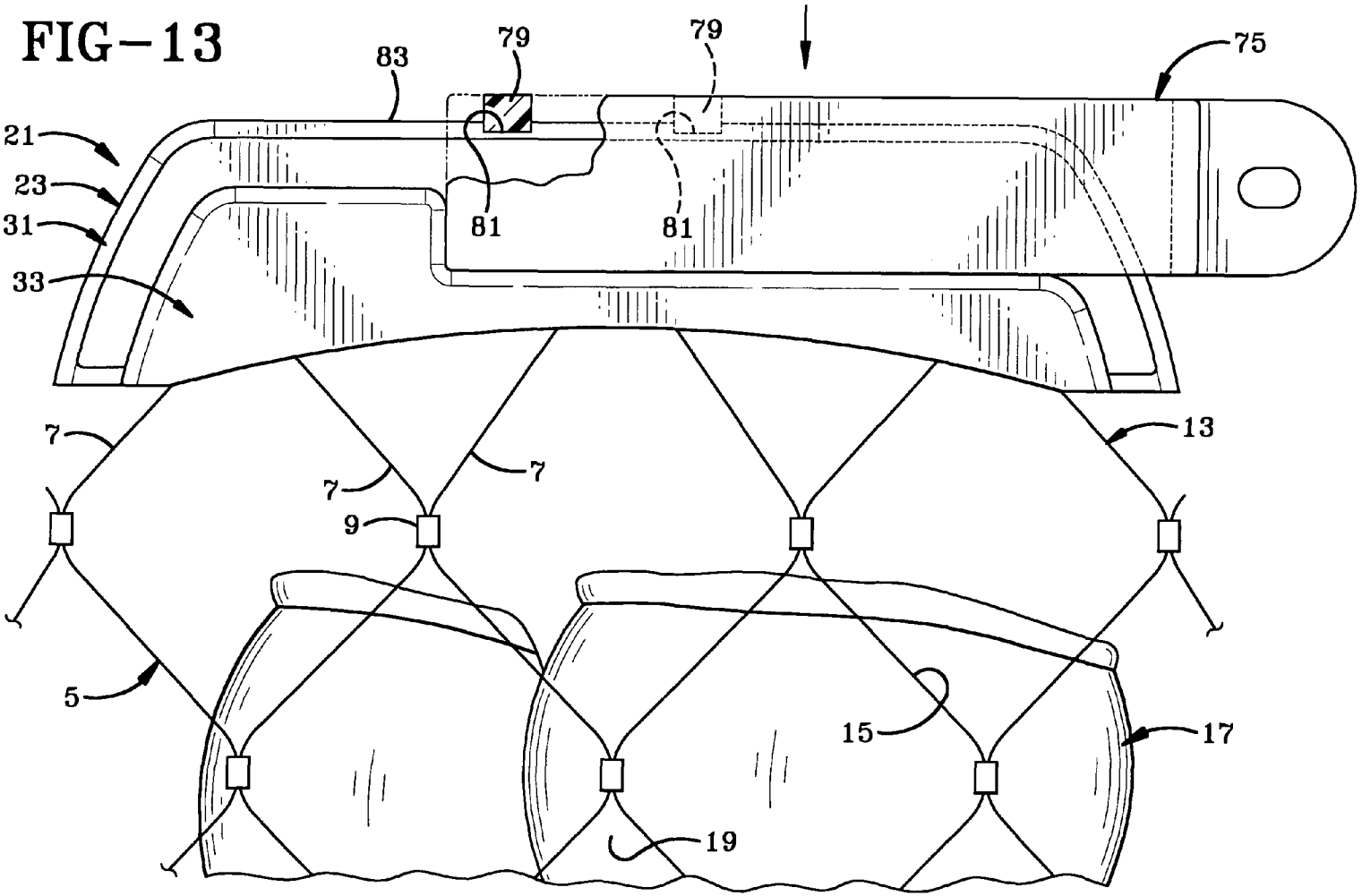
FIG. 13 is an enlarged fragmentary view with portions in section showing the magnetic key in position to unlock the locking device.

To unlock locking device 21, a magnetic key 75 preferably containing a pair of magnets 77 (FIGS. 13 and 14), is placed in close proximity to locking strip 43 and magnetically attract tines 49 to move them from the locked position of FIG. 12 to the unlocked position of FIG. 14. This enables inner housing 25 to be moved in the direction of arrow D (FIG. 15) to the unlocked position permitting locking members 23 and 25 to be separated as shown in FIG. 9. Bag opening 13 can be spread apart for removal of the stored merchandise. Key 75 preferably has one of more positioning tabs 79 for placement in notches 81 which are formed in the top peripheral edge 83 of housing 31, as shown in FIGS. 1 and 7. This insures that key magnets 77 are properly aligned with tines 49 in order to retract the tines to the unlocked position.

The unique merchandise security display bag of the present invention provides a relatively simple and inexpensive device in which the mesh bag preferably is formed of metal wire or other types of material which is not readily cut or pulled apart by a potential thief. The bag enables a merchant to store various shapes of objects in a secure protected manner and enables a prospective purchaser to readily see the items stored therein. The merchandise is secured in a locked position by locking device 21 which is comprised of two plastic components, except for internal spring strip 43. This enables the locking device to be mass produced relatively inexpensively, with each of the components being comprised of two members which when secured together by an ultrasonic weld, an adhesive, etc. will trap the closed loop ends of approximately one-half of the bag end opening periphery in each of the locking members. This enables the locking members to be retained permanently on the bag and provides a convenient manner for enlarging the open top end 13 of the bag for placement and removal of the items of merchandise into and from storage chamber 19.

The lock device 21 is easily snapped into a locked position by slidably inserting locking member 25 into lock chamber 54 of locking member 23. Device 21 is easily opened by use of magnetic key 75. Mesh bag 5 can be formed in various sizes of mesh and can safely store various items of merchandise. For example, a number of blister or bubble packs can be contained within bag 5 and supported on rods 3 by mounting holes formed in the inner packages and then removed by store personnel when needed for individual placement on the support rods. The mesh bag can be produced very inexpensively as well as plastic locking members 23 and 25.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security bag for displaying items of merchandise comprising:

a flexible mesh bag formed of metal wire having a top opening providing access to an interior storage chamber for receiving an item of merchandise; and a locking device for securing the top opening in a closed locked position, said locking device including first and second locking members, each connected to a portion of the top opening of the bag and lockingly engageable with each other, said first locking member having a magnetically attractable locking member engageable with a locking tab formed on the second locking member to lock said members in the closed locked position, and wherein the second locking member is slidably received within a locking chamber of the first locking member when the first and second locking members are locked together in the closed locked position.

2. The security bag defined in claim 1 wherein the first and second locking members are formed of plastic.

3. The security bag defined in claim 1 wherein the metal wire of the mesh bag is coated with plastic.

4. The security bag defined in claim 1 wherein a peripheral edge of the top opening of the bag is defined by a plurality of closed loops of the wire mesh; and in which approximately one-half of the closed loops are trapped in slots formed in a respective one of each of the first and second locking members.

5. The security bag defined in claim 1 wherein an EAS tag is located in one of the locking members.

6. The security bag defined in claim 1 wherein the first locking member includes a housing and a covered plate secured to said housing enclosing the locking chamber; in which the locking member is located within a recess formed in the housing and has a locking tine which extends into the locking chamber; and in which a rib is formed on the cover plate and clamps the locking member within the housing recess.

7. The security bag defined in claim 6 wherein the locking tab has a first surface for temporarily retracting the locking tine toward an unlocked position when the second locking member is received within the locking chamber and a second surface which engages the locking tine to secure the second member in the locked position with the first member.

8. The security bag defined in claim 1 wherein the locking member is an elongated strip of metal having at least one elongated locking tine extending outwardly therefrom; and in which the locking tab has a surface which engages an elongated edge of the locking tine when the first and second members are in the locked position.

9. The security bag defined in claim 1 wherein the second locking member is a two-piece member including an outer housing and a cover; and in which aligned slots are formed in the outer housing and cover and receive closed loop ends of the mesh bag therein for securing the second locking member to a peripheral portion of the top opening of the mesh bag.

10. A security bag for displaying items of merchandise comprising:

a flexible bag having an access opening for inserting and removing an item into and from a storage chamber formed within the bag, said bag being formed of a cut resistant material and having at least one open area for viewing the item within the storage chamber; and a pair of locking members for securing the bag opening in a closed locked position, each of the locking members being formed of a rigid plastic material and secured to the bag adjacent the opening, said locking members being moveable between locked and unlocked positions with respect to each other, one of said locking members containing a magnetically attractable locking element for engaging a locking tab on the other of said locking members to secure said locking members in the locked position.

11. The security bag defined in claim 10 wherein the bag is formed of wire mesh having a peripheral edge defining the access opening; in which the peripheral edge is formed by a plurality of closed loops of the wire mesh; and in which approximately one-half of the closed loops are secured to a respective one of each of the pair of locking members.

12. The security bag defined in claim 10 wherein each of the locking members is a two-piece member including a housing and cover plate forming an internal chamber; and in which the locking element is located in one of the chambers and the locking tab is located in the other of said chambers.

13. The security bag defined in claim 12 wherein an EAS tag is located in one of the housing chambers.

14. The security bag defined in claim 10 wherein the pair of locking members have an elongated shape with a length approximately four times the width.

15. The security bag defined in claim 11 wherein the wire mesh is covered with a plastic.

16. The security bag defined in claim 10 wherein the locking element is a one-piece metal strip having at least one metal tine formed therein extending in an outwardly angled direction and terminating in a distal end.

17. The security bag defined in claim 16 wherein the metal tine has an elongated edge at least twice the length of the distal end; and in which the elongated edge engages the locking tab when securing the locking member in the locked position.

18. The security bag defined in claim 10 in combination with a key, said key containing a pair of spaced magnets adapted to align with a pair of spring biased locking tines formed on the locking element to move said locking tines from a locked position to an unlocked position.

19. The security bag defined in claim 10 wherein one of the locking members is slidably received within a locking chamber formed in the other of said locking members for lockably engaging the locking element with the locking tab.

20. A security bag for displaying items of merchandise comprising:

a flexible metal mesh bag having a top opening providing access to an interior storage chamber for receiving an item of merchandise; and a locking device for securing the top opening in a closed locked position, said locking device including first and second locking members, each connected to a portion of the top opening of the bag, said first locking member having a magnetically attractable locking member, wherein the second locking member is slidably received within a locking chamber of the first locking member when the first and second locking members are locked together in the closed locked position, and wherein the magnetically attractable locking member engages a locking tab formed on the second locking member when in the closed locked position.

* * * * *